US005398472A

United States Patent [19]

Eichelkraut

[11] Patent Number: 5,398,472

[45] Date of Patent: Mar. 21, 1995

[54] FIBER-BALE COMPOSITE STRUCTURAL SYSTEM AND METHOD

[75] Inventor: Gerald C. Eichelkraut, Santa Fe, N. Mex.

[73] Assignee: The Shandel Group, Carson City, Nev.

[21] Appl. No.: 20,290

[22] Filed: Feb. 19, 1993

[51] Int. Cl.[6] ..... E04B 9/00

[52] U.S. Cl. ..... 52/443; 52/745.09; 52/380; 52/381

[58] Field of Search ..... 52/380, 383, 405.1, 52/443, 744, 745.09, 745.1, DIG. 9

[56] References Cited

U.S. PATENT DOCUMENTS

| | | | |
|---|---|---|---|
| 225,065 | 3/1880 | Leeds . | |
| 312,375 | 2/1885 | Orr . | |
| 801,361 | 10/1905 | Clayton et al. . | |
| 1,402,593 | 1/1922 | Gauvin | 52/405.1 X |
| 1,604,097 | 10/1926 | Hewlett et al. . | |
| 1,633,702 | 6/1927 | Hewlett et al. . | |
| 1,994,644 | 3/1935 | Harshberger | 52/745.1 X |
| 2,964,800 | 12/1960 | Dorsett | 52/745.1 X |
| 3,300,943 | 1/1967 | Owens | 52/744 |
| 3,559,355 | 2/1971 | Day | 52/383 X |
| 3,979,870 | 9/1976 | Moore | 52/443 X |
| 4,292,775 | 10/1981 | Howard | 52/744 X |
| 4,301,198 | 11/1981 | Prior | 428/2 |
| 4,397,128 | 8/1983 | Wolde-Tinsae | 52/443 X |
| 4,452,028 | 6/1984 | Norton | 52/744 |
| 4,597,237 | 7/1986 | Celli | 52/405.1 X |

OTHER PUBLICATIONS

"Splendor out of Grass", article *Sage Magazine,* Aug. 2, 1992 (p. 14).

"Bricks of Bales, Walls of Straw", news article *Features Section, The New Mexican,* May 17, 1992.

*Primary Examiner*—Carl D. Friedman
*Assistant Examiner*—Beth A. Aubrey
*Attorney, Agent, or Firm*—Rod D. Baker

[57] ABSTRACT

The invention relates to systems and methods for quickly erecting horizontal and vertical structural members for use in residential, commercial, or industrial construction. The system utilizes building blocks composed of baled straw or other fibrous material, resulting in structures that are energy efficient and environmentally innocuous. A portable, reusable temporary support system is disclosed. The baled fiber blocks are stacked into wall or roofing components. Reinforcing ribs or beams are provided to enhance the load bearing capabilities of the component, and the bales are covered on their exposed faces with a rigid durable layer, preferably pneumatically applied concrete. Methods and apparatuses are disclosed for transferring shear forces between rigid exterior layers, vastly improving the structural integrity of the structural components.

46 Claims, 6 Drawing Sheets

FIBER-BALE COMPOSITE STRUCTURAL SYSTEM AND METHOD

OTHER RIGHTS

A portion of the disclosure of this patent document contains material which may be subject to copyright protection. The owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention (Technical Field)

The invention relates to a system and method for erecting an engineered, composite structural assembly suitable for residential or commercial buildings.

2. Background Art

One of mankind's most longstanding needs, and one to which enormous effort has been devoted over time, is the need for inexpensive yet adequate shelter from the elements. While developments in structural and materials engineering, architecture, and construction financing have improved the speed, efficiency, and cost-effectiveness of residential and commercial/industrial building, a need remains for a system of building construction, particularly residential construction, that is comparatively inexpensive, quick, and makes expanded use of renewable resources. In recent years particularly, increased focus has been placed on the need to develop construction methods and materials that minimize impacts on energy demands and environmental quality. Among other concerns are a wide-felt demand for buildings and dwellings that are energy-efficient, thereby reducing demand on energy sources, especially the non-renewable fossil fuels resources. Similarly, there is a heightened awareness of the importance of maximizing the use of readily renewable sources of construction materials.

Straw is a simple, inexpensive, widely available, renewable resource that for centuries has seen application in the art of building construction. Straw has been a binding, reinforcing, and insulating agent in mud-brick and adobe construction since prehistoric times. Houses constructed from compressed organic matter are still used today, and were commonly found in the embodiment of the "sod" houses of the midwestern United States during the nineteenth century.

More recently, the possibility of expanding the use of straw and other fibrous organics beyond their traditional role has received attention in the art. Use of straw as a primary, rather than ancillary, construction material presents recognized advantages. Straw or other shredded material, when bound into bales and stacked to form walls and roofs, offers desirable structural characteristics of low weight, corrosion and rust resistance, very high insulation value, and versatility. Additionally, straw as a primary construction material is economical and widely available. Moreover, straw comprises a renewable natural resource that presently is mostly wasted—making it attractive from an environmental, as well as economical, standpoint.

U.S. Pat. No. 225,065 to Leeds, entitled *Building Houses, Barns, Fences, & c.,* discloses a mode of erecting structures, consisting of stacking baled matter within wooden corner posts and capping them with wooden planks. No surface coating or finishing is suggested.

U.S. Pat. No. 312,375 to Orr, entitled Wall of *Buildings and Other Structures,* discloses a system for erecting walls consisting of stacked bales of material, the bales being compressed vertically between screw-actuated compression plates at the top and bottom of the walls. No rigid framework or support system, temporary or permanent, is disclosed.

U.S. Pat. No. 801,361 to Clayton, et al., entitled *Composite Building Structure,* teaches the formation of walls and roofs fashioned from concrete shells. The shells are parallelly spaced by concrete webs perpendicularly disposed between the shells to form discrete cells, which cells are filled with baled or compressed straw. The assembly evidently purports to be self-supporting during construction, or is pre-constructed in modules and then stacked, as no framework or temporary support system is disclosed.

U.S. Pat. No. 1,604,097 to Hewlett, entitled *Wall Structure,* shows a construction system using fibers coated with a binding agent which are tamped into a mold and allowed to dry to form a rigid, yet light and porous, building block. The rigid blocks are then stacked to form a wall, and include holes therethrough to serve, when aligned into vertical "passageways," as molds for poured concrete columns. As disclosed, the system requires the manufacture of individual blocks by mixing the binding agent with the fibrous material to exacting specifications to form what is, essentially, a type of brick.

U.S. Pat. No. 1,633,702 to Hewlett, et al., entitled *Building Structure,* discloses a variation on the invention of the '097 patent to Hewlett.

U.S. Pat. No. 4,301,198 to Prior, entitled *Building Component and Method of Making the Same,* shows a system for making building components consisting of a rigid form or mold filled with shredded material and coated with a plastic or resinous "skin."

Previous efforts to adapt straw-bale construction methods to modern, conventional, building needs have been hampered by structural limitations. Some of the advantages of straw bales (e.g. reduced weight, low-density) also present limitations to structural strength. Baled straw is very compressible and comparatively lightweight and flexible; consequently, a straw bale cannot merely be treated as just another type of brick for building purposes. Walls composed of straw bales must be supplied with reinforcing features to add stability and load-bearing capabilities.

Additionally—and especially since the nature of straw bales prohibits their being securely mortared together at their joints to form a monolithic wall—some means must be provided to add tensile and compressive strength to a straw-bale wall, especially at its interior and exterior faces where bending moment stresses are at their maximum. Merely coating the faces of a straw-bale wall with a stiffening substance is insufficient to serve the latter function; without effective means for transferring shear forces between the respective faces, the faces will act independently, severely reducing the wall's effective moment of inertia. Also, most baled-fiber wall systems must be adequately and temporarily supported and stabilized during erection, when wind loads and other perturbations can easily upset an entire wall. The present invention addresses these and other shortcomings of the methods of the prior art.

SUMMARY OF THE INVENTION (DISCLOSURE OF THE INVENTION)

The invention relates to systems and methods for erecting structures. Shredded plastics, straw, shredded paper, or other organic or non-organic balable materials are pressed or bundled into bales for use as basic building blocks. The bales preferably are carefully engineered as to size, shape, density and moisture content so as maximize thermal insulative value as well as structural integrity. The bales are laid in horizontal rows to form roof/wall systems, or staked in vertical courses to form wall systems. Thus placed, the contiguously arranged bales present two exposed faces. The stacked or laid bales are provided with reinforcement ribs or beams. In the preferred embodiment of the invention, open channels or gaps, comprising empty space, are left at regular intervals in the arranged bales to accommodate the placement of reinforcing elements. The open channels, preferably lined with plastic liners, serve as forms for wet concrete placed therein to comprise the reinforcing elements. Steel rebar or other conventional reinforcing rods are disposed in the channels, and concrete is placed into the channels and around the rebar to comprise the main substance of the reinforcing element. Thus the preferable manner of reinforcement is reinforced concrete; other alternative modes of reinforcement are disclosed.

In the preferred embodiment, wet concrete is disposed into the rib and/or beam forms by pneumatic processes, e.g. the "blowing" of wet cement or "gunnite" common in the art of constructing swimming pools and the like. Placement of wet concrete into the reinforcing element forms is followed by the placement, also by pneumatic processes, of layers of concrete upon the dual faces of the arranged bales. According to the invention, the arranged bales are thus covered by a hard layer, e.g. finished concrete, on their two exposed faces.

An important aspect of the invention relates to the provision of means for transferring shear forces between the hard layers on the faces of the arranged bales. In the preferred embodiment, sturdy wall ties are mounted within the bales, and also within the reinforcing ribs/beams, in such a manner as to be rigidly attached to the hard layers fixed upon the opposing sides of the wall or roof. By this means, the opposing exterior faces of the wall or roof component are rigidly connected, and shear forces acting along one face of the component are readily transferred to the other face, enhancing the structural integrity and loading capacity of the roof or wall component.

The preferred embodiment of the invention includes features which enhance the insulative value of the system. The fiber bales are inherently excellent thermal insulators. Thermal breaks, preferably insulating plastic foams, are placed within each reinforcing rib or beam. Additionally, the shear transfer devices of the preferred embodiment include composite or plastic connectors, so located as to prevent loss of thermal energy along the shear transfer devices.

A mode of providing temporary support to structural components during their erection is disclosed. In the preferred embodiment, a temporary support system is placed against a second face of a partially completed component while a first face is finished with a hard layer. The temporary support system provides stability and direction to the partially completed component. When the hard layer disposed upon the first face has cured to provide the component with strength, the temporary support system is removed to allow the finishing of the second face.

A primary object of the present invention is to provide a means and method for erecting inexpensive, energy-efficient structures.

Another object of the invention is to provide a means and method for making extensive use of renewable construction materials resources.

Still another object of the present invention is to provide a means and method for rapidly erecting comparatively inexpensive structures.

Another object of the invention is to provide a means and method for improving the structural strength of fiber-bale composite structures by enhancing shear transfer.

Another object of the invention is to provide a means and method for temporarily supporting structures during their construction.

A primary advantage of the present invention is that structures constructed according to the invention are energy-efficient.

Another advantage of the invention is that it makes use of renewable resources presently mostly wasted.

Another advantage of the invention is that it is adaptable and widely applicable.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODE FOR CARRYING OUT THE INVENTION)

The invention relates to a system for erecting structures of various types using baled fibers and concrete as the primary construction materials. The invention may satisfactorily be practiced to erect residential, commercial, or even industrial buildings, although it is contemplated that the invention shall have most widespread application in residential construction. The system of the invention may include the erection of walls, roofs, and floors. One of the advantages of the system is the erection of construction components having tremendous insulation qualities (high R-value), suggesting that the preferred use of the invention is with the construction of roofed dwellings. Nevertheless, roofless, walled enclosures could satisfactorily be built using the system of the invention.

A preferred fibrous construction material is regular alfalfa or timothy straw. A variety of other materials may be substituted in lieu of straw, however, including shredded hemp or paper, shredded cornstalks, shredded plastic, or any other loose, fibrous material capable of being pressed and bound into flat-sided bales. Throughout this specification and the claims, the term "straw" shall be used and understood to mean any suitable balable fibrous material, and "bales" shall mean any formed blocks or bales of any suitable fibrous material.

An important additional feature of the invention is the use of a temporary support system to stabilize walls during the course of their construction. The temporary support aspect of the invention and the method of constructing a wall are repeated, with indicated adaptations and variations, throughout the erection of the plurality of walls required to complete the desired structure. Description of the erection of one wall (or floor/roof) and its accompanying temporary support elements will, therefore, enable one skilled in the art to adapt and adjust the disclosed method and system to accomplish the erection of any number of walls (and/or roof or floors) needed to erect a more complex structure.

Figure 1:
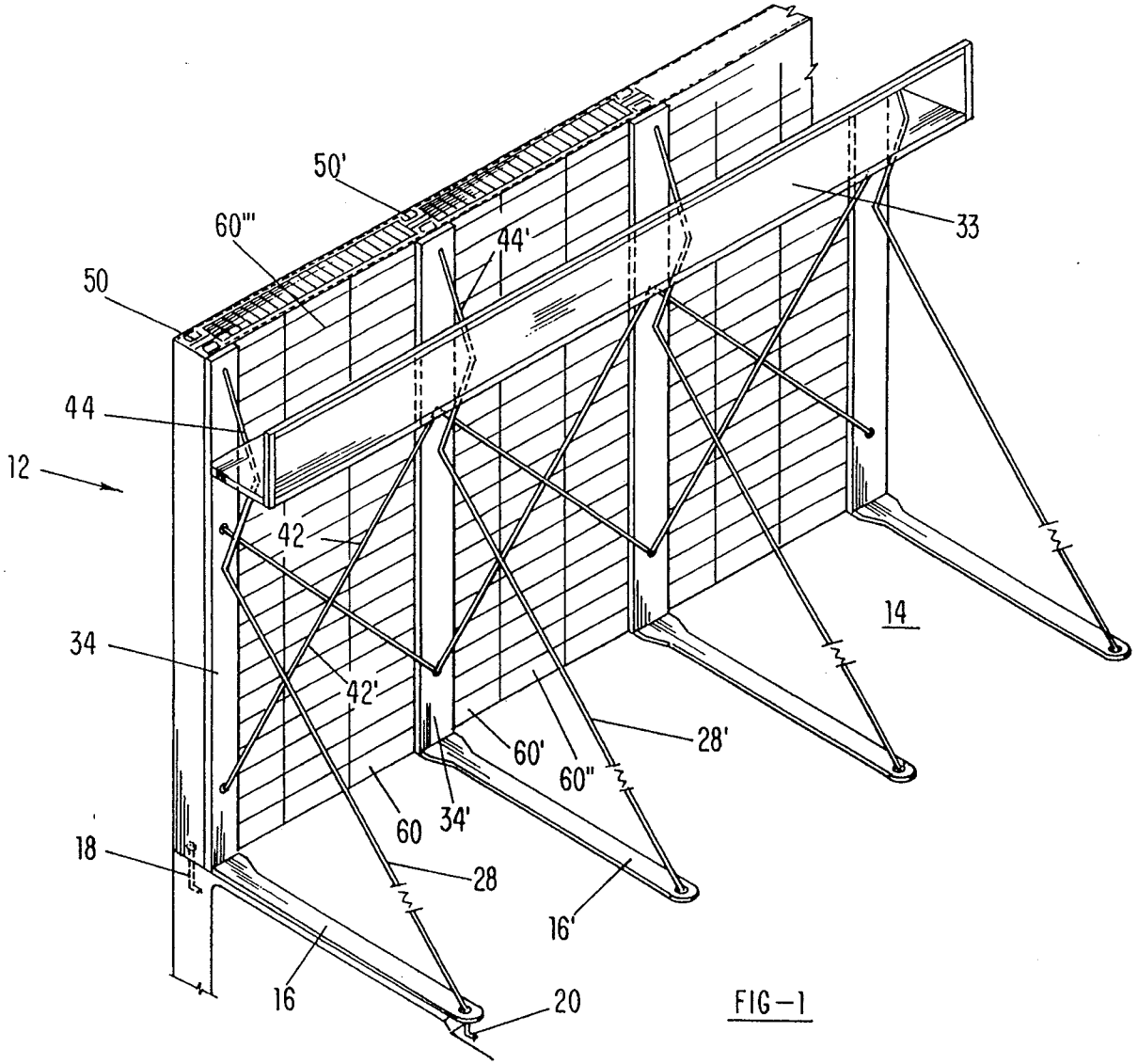
FIG. 1 is a perspective view of a partially completed wall, showing the use of a temporary support system, according to the preferred embodiment of the invention.
Figure 2:
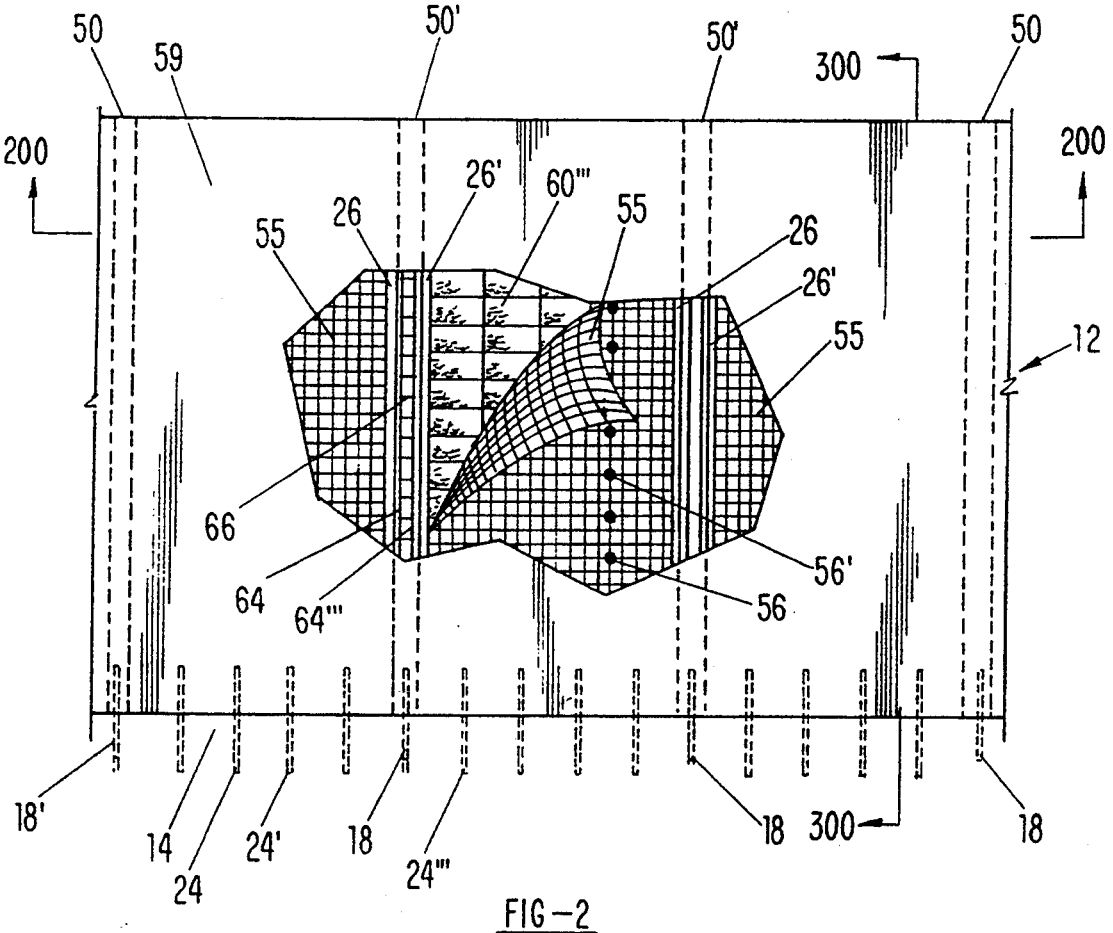
FIG. 2 is an elevation view of a finished embodiment of FIG. 1, with a portion broken away to disclose internal elements.

Attention is now invited to FIGS. 1 and 2, partially illustrating the practice of the invention in order to erect a wall (the wall labelled generally at 12). The invention preferably is practiced upon a conventional poured, reinforced concrete slab 14 common to the construction art. Other ground pads may be utilized, provided the pad is sufficiently stable to allow the securing of various elements of the invention to the pad. Concrete slab 14 is preferred for its ability to retain anchor bolts 18,20 and steel rebar ties 24,24',24'' used to secure the wall 12 to slab 14 as hereinafter explained.

Practice of the invention includes the formation and manipulation of bales 60,60',60'',60'''. Formation of bales 60,60',60'',60''' preferably occurs at a central plant remote from the job site. Bales 60,60',60'',60''' may be engineered as to size and shape; it is contemplated that a processing facility will press and bind bales 60,60',60'',60''' into a series of standardized shapes and sizes, as is common in the art of brick manufacturing, for ready use in the various applications called for on the construction site. Central processing offers economy of volume.

Importantly, formation of bales 60,60',60'',60''' at a central facility permits their formation and binding to optimum conditions of density and water content. As the fibrous material of bales 60,60',60'',60''' is cut and/or shredded and/or otherwise processed, its moisture content can be carefully reduced to ideal levels using conventional drying techniques. Also, as the fibers are baled into blocks, the specific density of the produced bales 60,60',60'',60''' is monitored and controlled, such that the finished product is as dense as possible within design requirements of weight and insulative value. The formed bales 60,60',60'',60''' may then be packaged, e.g. hermetically packaged, for mass distribution to a plurality of job sites as needed.

Bales 60,60',60'',60''' can be manufactured in a variety of sizes; a very manageable bale size is $1.0' \times 1.0' \times 3.0'$. As the fibrous material (e.g. timothy straw) is pressed into a bale of any particularized dimensions, the weight of the material forming the bale may be automatically and continuously monitored using digital scales technology in order to maintain a specified density (weight per unit volume). Density of bales 60,60',60'',60''' may be varied from project to project, and even among different locations within a project, or among different locations within a single wall. It may be desirable, for example, to increase density in bales 60,60' near the bottom of a wall 12 in order to minimize structural compression. Bales 60''' higher in a wall 12 may be deliberately less dense to enhance insulative value.

Similarly, the contained moisture of bales 60,60',60'',60''' may be monitored and controlled, particularly in bales composed of organic fibrous material. Low moisture content is desirable to impede organic decomposition and reduce undesirable moisture condensation occurrences within wall 12. (Of course, the use of vapor barriers, venting, and other techniques known in the art of construction may find application in the practice of the invention.) Moisture content of bales 60,60',60'',60''' may be controlled with conventional forced air and/or heating techniques. Moisture content may be monitored by electronically monitoring the weight of a given bale (i.e. the specific density of a given formed bale will be lowered as water is removed from the bale).

When any given bale 60 has been formed to a desired modular size, density, and moisture content, it preferably is bound with recycled straps to maintain its integrity in transit. Bales 60,60',60'',60''' may then be vacuum-packed, or otherwise sealably packaged, individually or in batches, for storage or transportation.

Figure 4:
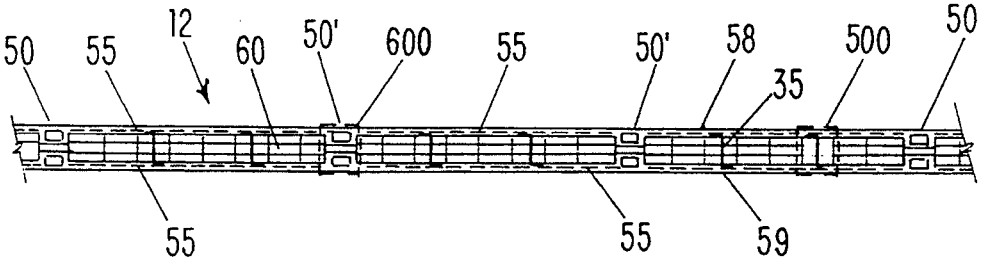
FIG. 4 is a plan sectional view of the FIG. 2 embodiment, taken along line A—A of FIG. 2.
Figure 11:
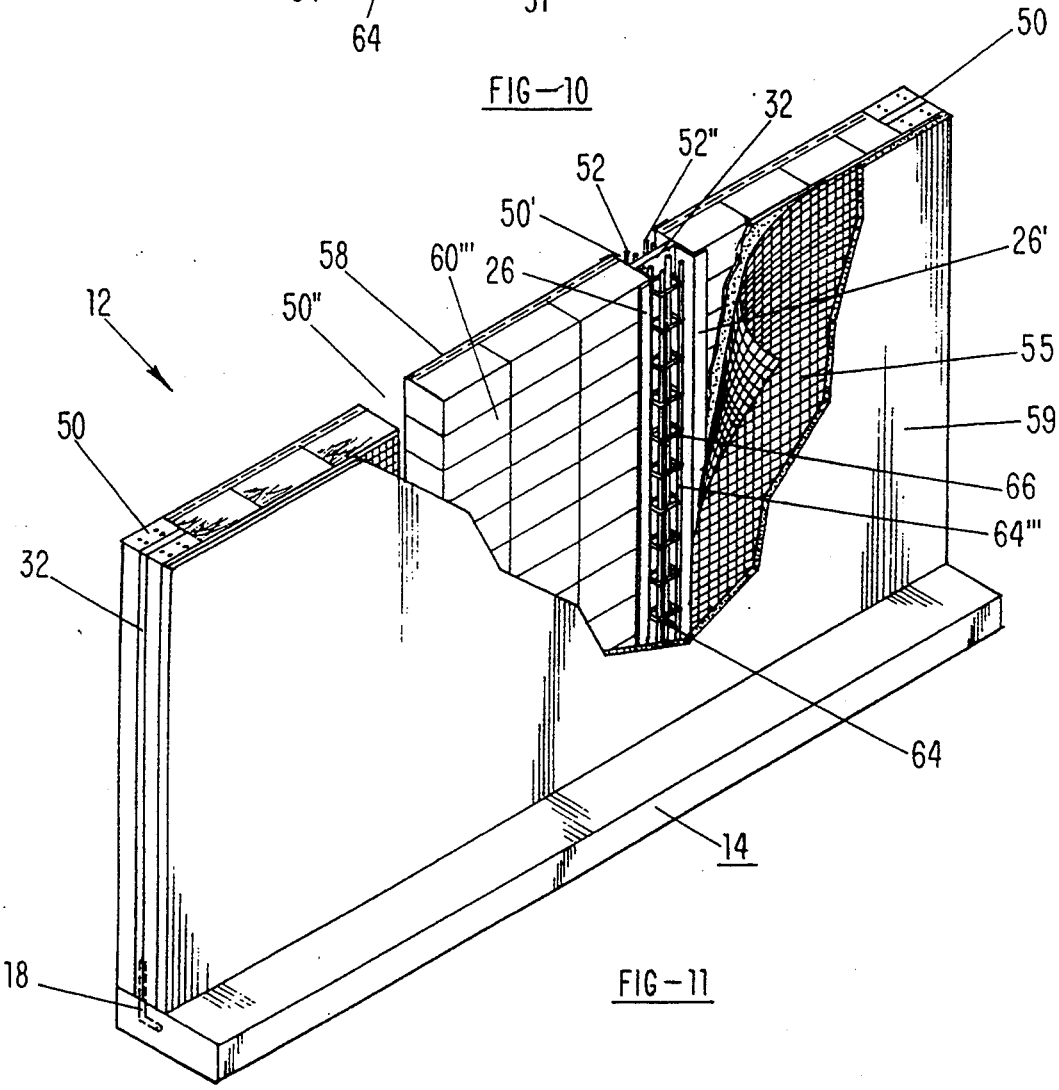
FIG. 11 is a perspective view of the embodiment of FIG. 1, showing a finished wall according to the invention with portions broken away to illustrate interior elements.

As seen in FIGS. 1, 2 and 11, a wall 12 of the invention is composed of laid courses of bales. Bales 60,60',60'',60''' are stacked in any of the patterns common to conventional bricklaying. Bales 60,60',60'',60''' may be of any manageable size, (e.g. $1' \times 1' \times 3'$). The joints may be broken with every course (running bond), or, as shown in FIG. 1, the bales may be aligned in vertical columns (stacked bond). At regular intervals (e.g. 10 feet) along the length of a particular wall 12, allowance is made for the construction of vertical ribs 50,50' which enhance the stability and load-bearing capabilities of wall 12. FIGS. 1, 2 and 4 depict a "three-bay" wall, that is, a wall having three sections defined by two interior ribs 50' and two end or corner ribs 50. As shall shortly be explained, the bales 60,60',60'',60''' are so laid as to leave a vertical gap or channel at each anticipated location of each rib 50,50'. In the preferred embodiment of the invention, ribs 50,50' are fashioned from concrete blown into place using a pneumatic pump; the bales 60,60',60'',60''' themselves serve as the supporting forms to shape and hold the concrete ribs 50,50' while they set.

Figure 3:
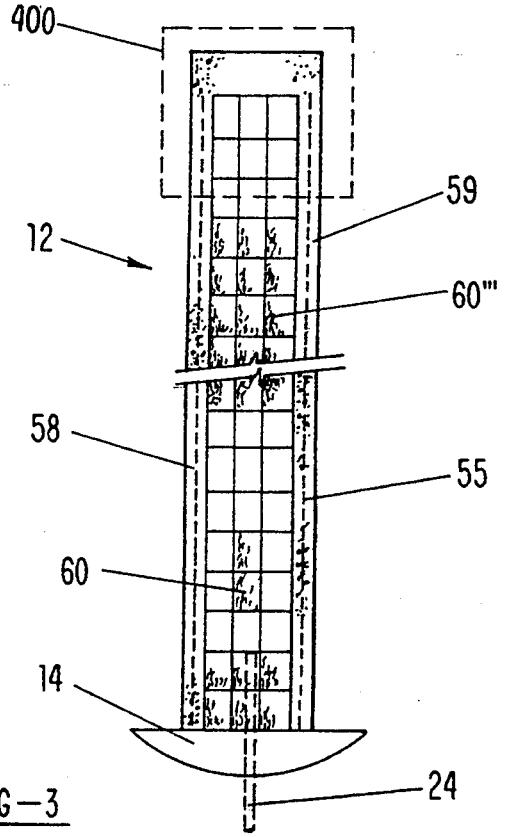
FIG. 3 is a vertical sectional view of the FIG. 2 embodiment, taken along line B—B of FIG. 2.

Reference is made to FIGS. 1–3. Practice of the invention is initiated by placing anchor bolts 18,20 and rebar ties 24,24',24'' vertically within slab 14, preferably by insertion into the wet concrete prior to hardening, in accordance with practices known in the art. As suggested by FIGS. 1–3, the precise locations of anchor bolts 18,20 and rebar ties 24,24',24'' is dictated by the layout and floor plan of the structure. Rebar ties 24 are disposed at regular intervals (e.g. 2.0 feet) along the centerline of the wall(s) 12, and are used to anchor the base course(s) of bales 60,60',60'',60''' to slab 14. A plurality of anchor bolts 18 are likewise located along at regular intervals (e.g. 10.0 feet) along the center line of wall 12, directly beneath the anticipated location of each rib 50,50'. As best shown in FIG. 1, anchor bolts 20 are placed perpendicularly inward (e.g. 12.0 feet) from wall 12 to accommodate temporary attachment of floor plates 16,16' to slab 14.

Reference is made to FIG. 1. Temporary support is provided by a network of components that are assembled and dissembled on-site. It is contemplated and preferable that the elements of the temporary support system be fashioned primarily of low-weight, high-strength alloys, or steel, or even wood or plastic, in order that they may be portable and reusable (e.g. capable of being repeatedly leased or resold to different contractors for use at multiple and/or consecutive projects). The temporary support elements include pluralities of long, flat floor plates 16,16', wall supports 34,34', wall braces 28,28', scaffold-type cross braces 42,42', and, optionally, brace extensions 44,44'. An optional work platform with guard rail 33 may be installed as needed to allow erection of higher walls. The support elements are assembled on-site into sets, with each set consisting of a floor plate 16, a wall support 34, and a wall brace 28. Each set corresponds to a vertical rib 50,50'; thus each "bay" between ribs 50,50' will ordinarily be supported by two sets of assembled support elements linked by cross braces 42,42'.

Erection of wall 12 preferably begins with the assembly of the temporary support systems. Floor plates 16,16' are secured to floor 14, preferably using regular nuts in combination with anchor bolts 20 and also using loop-ties (not shown) or nuts with anchor bolts 18. Wall supports 34,34' are removably attached to floor plates 16,16' using nuts and bolts or the like; alternatively, wall supports 34,34' are permanently hingably connected to floor plates 16,16', such that the two elements comprise a single, hinged, collapsible unit. Wall supports 34,34' alternatively may be welded or otherwise permanently and rigidly attached to floor plates 16, 16'. Without regard for the particular mode of attaching wall supports 34,34' to floor plates 16,16', it is observed that when properly installed, wall supports 34,34' will be perpendicular to floor plates 16,16' and to floor 14. A wall support 34 and accompanying floor plate 16 are disposed at each location corresponding to the planned location of a vertical rib 50,50', as best shown in FIG. 1.

Subsequent to the installation of wall supports 34,34' and floor plates 16,16', a rigid wall brace 28 is removably but rigidly secured to each floor plate 16 and wall support 34. As shown in FIG. 1, wall brace 28 is obliquely disposed in a "diagonal" fashion, so that the combination of floor plate 16, wall support 34, and wall brace 28 preferably form a triangle. Wall braces 28,28' preferably are fashioned from metal tubes common to the scaffolding art, and are secured to wall supports 34,34 using nut-and-bolt brackets or any other temporary, yet reliable, attachment.

Between adjacently erected wall supports 34,34' are then disposed rigid "scaffold" type cross braces 42,42'. Cross braces 42,42' serve to space supports 34,34' and hold them parallel to one another and perpendicular to slab 14. Attachment of cross braces 42,42' to wall supports 34,34' preferably is by means of nuts and bolts. For extra-high walls 12, brace extensions 44,44' may be used to support additional extensions of wall supports 34,34', which in turn support the added layers of bales 60,60',60'',60'''.

It is observed, therefore, that the temporary support system is a rigid, self-supporting network, resistant to collapse in any direction. The entire network is secured to the ground by anchor bolts 18,20 or other means known to the art. Cross braces 42 prevent collapse in the direction parallel to the plane of the wall 12, while wall braces 28,28' prevent collapse in directions normal to the wall 12. This temporary support system functions to direct the proper stacking of the bales 60,60',60'',60''', and, more importantly, to support the stacked bales pending the completion of the wall. Particularly, the placing of the support system protects partially completed wall 12 from potentially disastrous wind loads.

The flexibility of the invention permits walls 12 to be erected one at a time consecutively, but it is preferable to erect temporary support systems for several adjacent walls 12 and then stack adjoining walls 12 simultaneously. Simultaneous erection of adjoining walls 12 (and their respective accompanying support systems) fosters overall structural integrity. Design layout permitting, all necessary support systems for an entire structure may be assembled, followed by the stacking of all the bales 60,60',60'',60''' to form the walls. It is noted that, as shown in FIG. 1, floor plates 16,16' preferably are secured to the floor 14 on the interior of the planned enclosure. Alternatively, plates 16,16' and associated wall supports 34,34', etc. may be secured directly to the ground outside the planned enclosed structure. Locating support systems without, as well as within, a confined enclosure allows simultaneous construction of a plurality of walls 12 while reducing interference between support systems and congestion caused by short, adjoining, perpendicular walls.

With the support system assembled, stacked placement of bales 60,60',60'', 60''' is commenced. Bales 60,60',60'',60''' are laid in courses. Wall 12 may be only one bale thick (e.g. FIG. 11), or several bales thick (e.g. FIGS. 3 and 4). As various bales 60,60',60'',60''' are stacked, adjacent bales are secured together, in both the vertical and horizontal directions, using metal or plastic stakes (not shown) which pierce adjoining bales. The bottom-most courses or layers of bales 60,60',60'',60''' are pierced by rebar ties 24,24',24'' to foster stability and anchor wall 12 to slab 14. Bales 60,60',60'',60''' are stacked snugly against wall supports 34,34' and cross braces 42,42', which vertically support the rising wall in place and in line. Severable temporary wire ties (not shown) staked to the faces of bales 60,60',60'',60''' may be used to temporarily attach bales to cross braces 42,42' and wall supports 34,34'.

Figure 5:
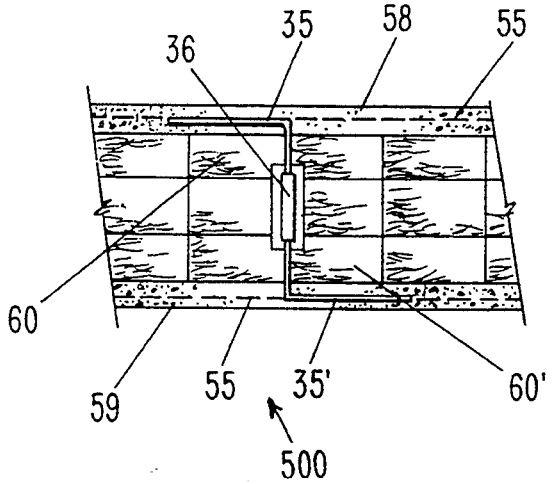
FIG. 5 is a detailed enlargement of section D—D of FIG. 4.

FIGS. 4 and 5 illustrate an important feature of the invention, the use of interior rebar wall ties 35,35'. Interior rebar wall ties 35,35' accommodate the transfer of shear forces between the outside faces of wall 12, causing it to act as a single unit and substantially enhancing its structural integrity under loading conditions. Interior rebar wall ties 35,35', with accompanying connectors 36, are installed within wall 12, among bales 60,60', while bales 60,60' are being laid, i.e., simultaneously with the stacking of bales 60,60'. Pairs of ties 35,35', connected by connectors 36, are placed at regular intervals (e.g. 3.0 feet) both vertically and horizontally within wall 12 between the anticipated locations of ribs 50,50'. As shall be further explained, very similar shear transfer devices are also installed at the location of each rib 50,50'.

Interior rebar wall ties 35,35' preferably consist of lengths of steel rebar (e.g. #4 rebar) bent into right-angles having one short leg (e.g. 6 inches) and one longer leg (e.g. 12 inches). As implied by FIG. 5, one end of each tie 35,35' is inserted into a corresponding opening in connector 36. Preferably, two rebar ties 35,35' inserted into opposite ends of a common connector 36 comprise a single shear transfer device to be placed at regular intervals within wall 12 as mentioned. As shown in FIG. 5, when properly installed one leg of each tie 35,35' penetrates the wall 12 at an angle normal to the face of wall 12, while the other leg preferably is disposed horizontally and parallel to a face of wall 12, a short distance (e.g. 1.5 inches) from actually contacting a bale 60,60'. In a finished wall, the longer legs of ties 35,35' are wired to a welded wire mesh 55, which mesh is then in turn contained within the exterior and interior surface hard layers 58,59 of concrete as further shown hereafter.

Connector 36 is an integral element manufactured from plastic, fiber composite, or other substance having high strength but low thermal conductivity. Connector 36 plays a role in the transfer of shear forces from one side of wall 12 to the other, thus strengthening the wall and presenting an advantage of the invention. Connector 36 used in conjunction with interior rebar wall ties 35,35' is identical with connector 36 used in conjunction with rib wall ties 37,37', to be explained in more detail below. Briefly stated here, connector 36 preferably is fashioned from a composite material having appreciable strength and excellent insulative properties. Typically, connector 36 is cylindrical with openings on each end to accept an inserted rebar wall tie 35,35'.

Figure 7:
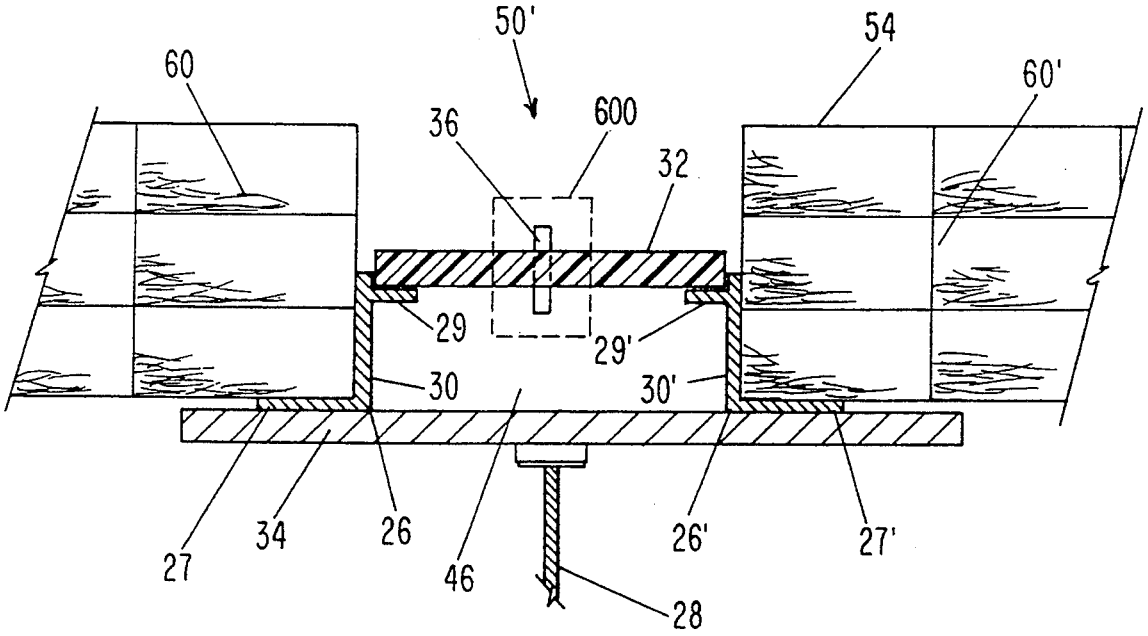
FIG. 7 is a detailed enlargement of section E—E of FIG. 4, showing a plan view at an early stage of the preferred embodiment of the invention.
Figure 9:
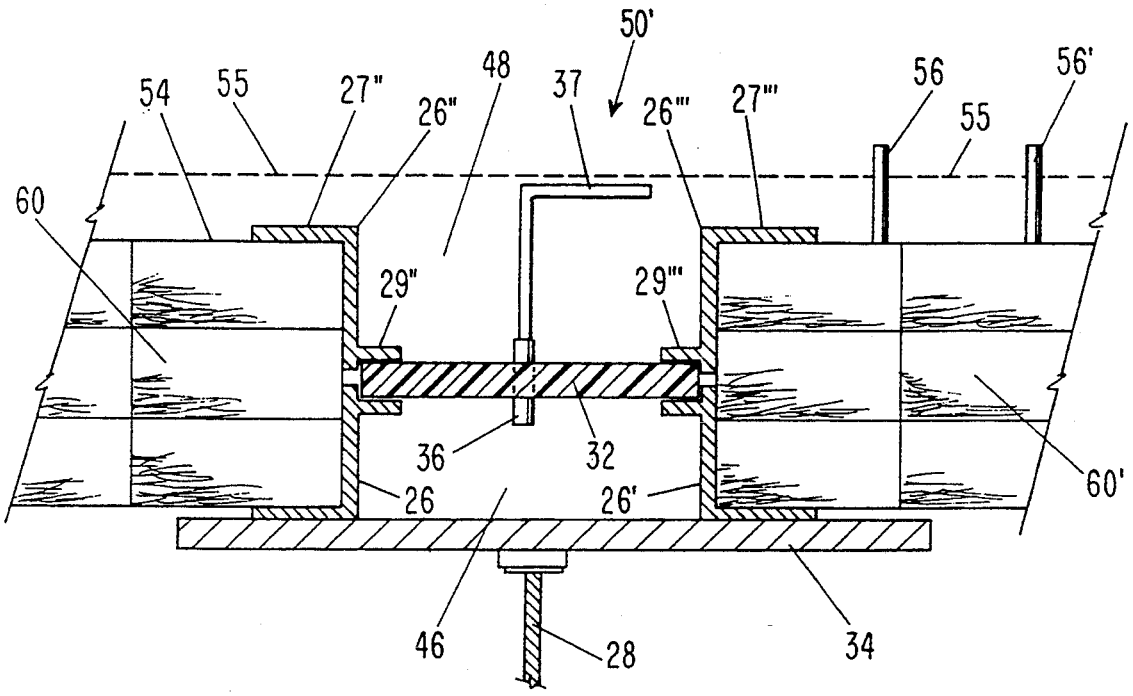
FIG. 9 shows the embodiment of FIG. 7 at a later stage of the practice of the invention.

Importantly, the rising wall of stacked bales 60,60',60'',60''' is discontinuous at the corners of adjoining walls and periodically along the length of each wall 12 to allow for the formation of vertical ribs 50,50'. As best shown in FIGS. 1 and 9, the vertical discontinuities correspond to the locations of wall supports 34,34', such that three-sided vertical hollows or chambers are defined by the stacked bales 60,60',60'',60''' and the wall supports 34,34' (although wall supports 34,34' are wider than the space between the layers of bales 60,60',60'',60''' and overlap the faces of bales 60,60',60'',60''' as shown in FIGS. 1 and 7). The vertical hollow columns thus defined serve as forms for wet concrete, as shall shortly be described.

When the final course of bales 60 has been laid, wall 12 approaches its final height. Unfinished wall 12 will consist of one or more "bays," e.g. contiguous bales 60,60',60'',60''' laid up into a discrete vertical section separated by the vertical, unfilled spaces corresponding to the locations of ribs 50,50', i.e. note unfilled space at location of rib 50'' on FIG. 11. These vertical empty "columns" will be open on one side, i.e. open towards the side opposite the location of the corresponding wall support 34, either toward the interior of the exterior of the structure.

Construction of the substance of ribs 50,50' is now initiated. As most clearly illustrated in FIG. 7, simultaneously with the stacking of bales 60,60', rib liners 26,26' are installed against each wall support 34 between the inside face of wall support 34 and the bales 60,60'. Rib liners 26,26' are used to line the hollow columns serving as forms for ribs 50,50'. Rib liners 26,26' provide a clean uncontaminated form for the concrete in ribs 50,50'. Rib liners 26 are made of inexpensive flexible or semi-flexible plastic, and may be manufactured and/or cut on site to the appropriate length. Ideally, rib liners 26 are manufactured from recycled plastics. Liners 26 may be installed segmentally in series as the wall is erected, or, alternatively, installed in one single length or "ribbon" equalling the height of the associated rib 50. Each length of liner 26 preferably has an exterior tab 27 and an insulation retainer tab 29 running throughout the length of main flange 30.

As shown in FIG. 7, rib liners 26,26' are disposed vertically upon the stacked bales 60, using small metal or plastic stakes (not shown), to the corners of the bales 60,60',60'',60''' adjacent to the various locations of the ribs 50,50'. Exterior tab 27 is placed flush against the exterior facade of unfinished wall, while main flange 30 is pressed flush against the face defining the rib 50. Attaching stakes (not shown) are driven through main flange 30 and into the adjoining bales 60,60'; alternatively or supplementally, exterior tab 27 may be temporarily attached (e.g. mild adhesive) to wall support 34. Liners 26,26' are progressively installed, in short lengths laid vertically end-to-end, concurrently with and at the pace of the erection of the wall 12. As shown in FIGS. 2 and 11, the installed liners 26,26' run the complete height of the wall 12.

Continued reference is made to FIG. 7. Besides functioning as form liners, liners 26,26' also serve to hold in place a vertically disposed thermal break 32. Upon the stacking of bales 60,60' and placement of liners 26,26' on the sides of each rib location, thermal break 32 is disposed vertically within the rib location by being placed against the retainer tabs 29,29' of liners 26,26'.

Thermal break 32 is a manifestation of an advantage of the invention. Thermal break 32 is an insulating layer which permits the erection of reinforcing ribs 50,50' without sacrificing the insulation value of the overall wall 12. Thermal break 32 preferably consists of a wide strip or sheet (e.g. 3.0 inches thick) of plastic foam (e.g. Styrofoam ®) common in the construction industry for its insulating properties. Thermal break 32 is manufactured or cut on site to have a width approximately the same as the width of the rib form in which it is placed. Thermal break 32 is installed to a height equalling the height of wall 12 (FIG. 11), and may be a single length or a series of shorter lengths laid vertically end-to-end. As seen in FIG. 7, the break 32 preferably is snugly inserted between bales 60 and 60' and in frictional contact with main flange 30 and retainer tab 29 of each of liners 26,26'.

Figure 8:
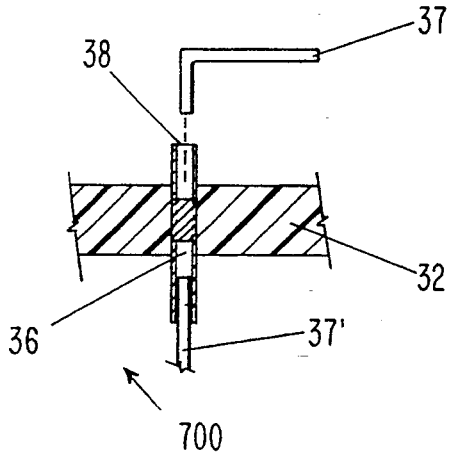
FIG. 8 is a detailed enlargement of section F—F of FIG. 7.

Also shown in FIGS. 8 and 9 is the use of connector 36, which has identical structure and function in association with thermal break 32 and rib wall ties 37,37' as it does with interior rebar wall ties 35,35' as described above. Connector 36 is disposed and frictionally held within holes pre-punched through thermal break 32. Each connecter 36 when properly installed extends an equal distance outward from either side of thermal break 32. A plurality of connectors 36 are employed at each rib location, preferably at regular intervals (e.g. 2.0 feet) along the vertical centerline of thermal break 32.

A detailed depiction of a connector 36 installed through thermal break 32 is provided at FIG. 8. Connector 36 preferably is cylindrical, with an opening 38 in each end to receive rebar rib wall ties 37,37'. The interior surfaces of openings 38 preferably are threaded or knurled to accommodate screwed or secure frictional insertion of rib wall ties 37,37' into each end of connector 36. It is noted that openings at the respective ends of connector 36 do not interconnect, so that the body of connector 36 serves as a thermal insulating barrier between rib wall ties 37,37'. Various connectors 36 may be manufactured in assorted standardized sizes and strengths, for particularized applications throughout the structure of a given project.

FIG. 7 is the plan view of a typical rib location between stacked bales 60 and 60', with first set of liners 26,26' in place between wall support 34 (supported by wall brace 28) and bales 60,60', and with thermal break 32 in place. Other rib locations have similar condition at this point of the practice of the invention. Corner ribs 50 to be located at corner intersections of two walls can be adapted to the corner circumstance in accordance with the foregoing and following description, such adaptations within the ability of a person of ordinary skill in the art. Corner ribs, because of their location at the juncture of two walls 12, will be simpler in construction; thermal breaks 32 and connectors 36 are optional at these locations.

The next step in the practice of the invention is illustrated in FIG. 9. A second pair of rib liners 26'',26''' is installed on the side of bales 60,60' opposite from first set 26,26'. The mode of installation of second set of liners 26'',26''' is identical to that of the first set 26,26', except for the reversed positions and the absence of wall support 34 as an auxiliary support. The retainer tabs 29'',29''' of liners 26',26'' are placed directly against thermal break 32. When the exterior tabs 27'',27''' of liners 26'',26''' are staked to the outside face 54 of bales 60,60', the four liners 26,26',26'',26''' serve to hold thermal break 32 securely in place. Thermal break 32 holds the requisite number of connectors 36, using a simple adhesive if needed.

Having continued reference to FIG. 9, it is seen that the presence of liners 26,26',26'',26''' and thermal break 32 serve to vertically divide the rib location into two distinct columns: an inside space 46 and an outside space 48 (as viewed from above). Inside space 46 is enclosed on four sides by wall support 34, bales 60,60' and thermal break 32; outside space 48 remains open on one side opposite from thermal break 32. In the preferred embodiment of the invention, these vertical columns of space 46,48 are filled with reinforced concrete, as shortly to be described, to comprise the principal structure of rib 50.

Reinforcing steel rebar is placed within outside space 48 for its entire height according to the particular design/loading requirement. Preferably, as shown in FIGS. 10 and 11, four lengths of vertical rebar (e.g. #5 steel rebar) 52,52',52'',52''', are parallelly situated in a square pattern, and then wrapped, at regular intervals along their height, with cut and bent lengths of horizontal bars 53 (e.g. #3 rebar) to erect the steel reinforcement cages common to the art of reinforced concrete design.

Reference is now made to FIG. 9, showing the use of welded wire mesh 55 and thickness control devices 56,56' upon the first or exterior face 54 of the stacked bales 60,60' forming the unfinished wall 12. In the present context, "exterior" face means that face of the wall 12 associated with outside space 48, e.g. the face opposite wall supports 34; although, as previously mentioned, that face 54 may actually affront the interior of the structure under construction. One layer of welded wire mesh 55 is installed upon exterior face 54 using wire pins and staples in a manner practiced by those of ordinary skill in the art of cement stucco. Double layers of mesh 55 may be installed at locations where added reinforcement may be desired, e.g. adjacent to the locations of ribs 50,50'. Mesh 55 is not placed snugly against bales 60,60', rather is disposed parallel to the face of the bales some distance (e.g. 1.5 inches) and there held by pins and stakes (not shown); accordingly, some concrete in the layer 58 will be disposed between mesh 55 and bales 60,60. Panels of wire mesh 54 are placed throughout the length and height of a particular wall 12, including coverage across the open sides of each open space 48 at each rib location. Concrete thickness control devices 56,56' are mounted upon exterior face 54, at appropriate intervals, also in a manner known in the art. Thickness control devices 56,56' are used to provide the necessary quality control, strike off points, and expansion control for the concrete.

Figure 10:
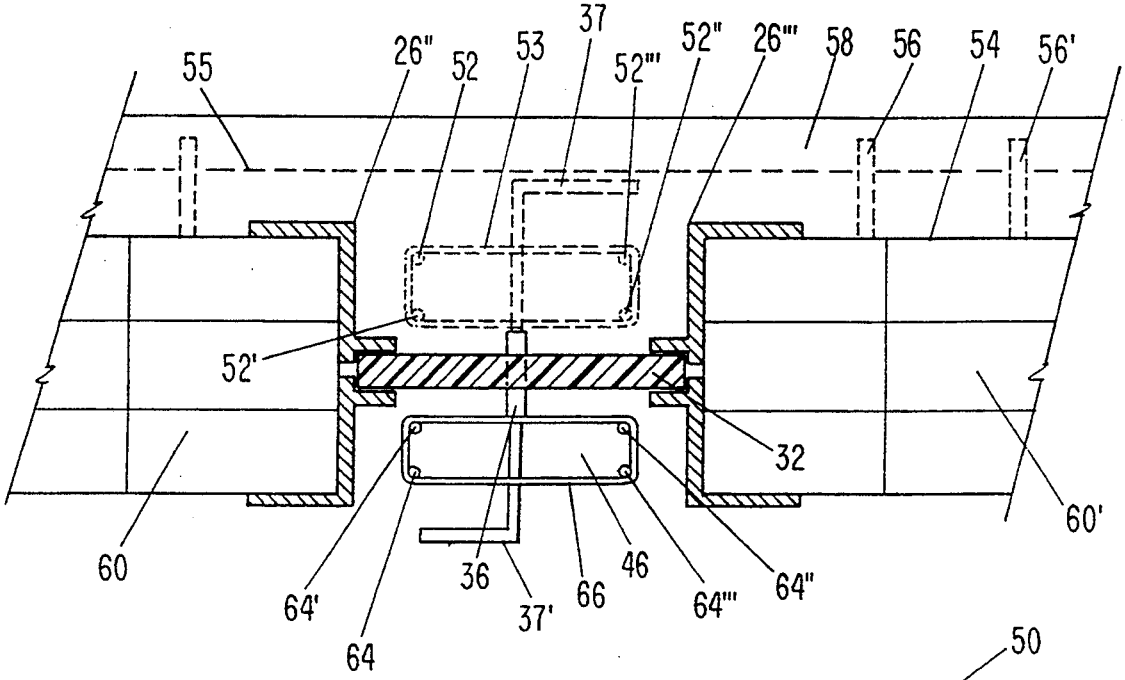
FIG. 10 shows the embodiment of FIG. 9 at a still later stage of the practice of the invention.

Combined reference is made to FIGS. 9 and 10. Rib wall ties 37,37' are of the same or similar construction as exterior rebar wall ties 35,35' as previously described. A plurality of pairs of rib wall ties 37,37' are installed within connectors 36 mounted at regular intervals along the vertical centerline of thermal break 32, and may be temporarily held in place by being wired to wire mesh 55.

The timing of the installation of rib wall ties 37,37' is somewhat flexible, but preferably is subsequent to the placement of wire mesh 55 for ease of proper placement. A distinction between interior rebar wall ties 35,35' and rib wall ties 37,37' has to do with the timing of installation. Because interior rebar wall ties 35,35' (FIG. 5) are placed during the stacking of bales 60,60', each of ties 35 and 35' are installed together, in pairs, joined by a connector 36. By comparison, the installation of rib wall ties 37,37' cannot proceed by pairs owing to the presence of wall supports 34,34'. Thus, all the rib wall ties 37 pertaining to the exterior face 54 of bales 60,60',60'',60''' are installed at about the same time, and the ties 37' pertaining to the interior of the wall are installed much later, after the exterior face 54 of has been finished and temporary wall supports 34,34' removed.

With the foregoing elements in place, installation of concrete is commenced. Reference is made to FIGS. 9 and 10. In the preferred embodiment, concrete installation is accomplished using pneumatic pumps, whereby the concrete is "blown" into place in a fashion similar to that utilized in the construction of "gunnite" swimming pools and similar applications known in the art. Concrete is provided to the job site by local ready-mix trucks or mixed on the job site in accordance with specifications and design mixes provided by the engineer or architect. To permit pneumatic application, the size of the concrete aggregate is limited; to meet most design criteria, concrete having a specified compressive strength ($F_c$) equal to at least 4,000 p.s.i., and a slump of 3–4 inches, is indicated.

Using the pneumatic pump/sprayer, concrete is blown first into the outside space 48 at each rib location. Care is taken to place concrete throughout the entire height of outside space 48, and completely around and between the various vertical rebars 52,52',52'',52''' and horizontal bars 53. Concrete also will surround the portion of each rib wall tie 37 projecting horizontally through outside space 48. Liners 26'',26''' serve as form liners, and the bales 60,60' themselves act as supporting forms. It is noted that, at this phase of the practice of the invention, no wet concrete is placed within each inside space 46 along the wall or in contact with wall supports 34,34'. With additional reference to FIG. 1, it is noted that wall supports 34,34', wall braces 28,28', floor plates 16,16' and their associated components of the temporary support system provide support and stability to the overall wall 12 throughout the process of placing concrete within the outside spaces 48 and upon exterior face 54.

When the outside spaces 48 at the location of each rib 50,50' along the subject wall 12 have been filled with concrete, placement of concrete continues uninterrupted to include the deposition of a concrete layer 58 upon the exterior face 54 of wall 12. Thus, concrete layer 58 preferably is placed so as to cure with and be joined to, the concrete within outside spaces 40.

Hard layer 58 completely covers the exposed faces of bales 60,60' making up exterior face 54. Thickness control devices 56,56' are used in a manner known in the art to control the thickness of concrete layer 58; thermal expansion joints may be provided in the hard layer 58 as required. Also, as shown in FIGS. 4 and 10, hard layer 58 placed so as to envelope both welded wire mesh 55 and the projecting legs of the wall ties 35 and 37. Thus, welded wire mesh 55 serves as a lath and reinforcement for the layer 58, and rebar ties 35 and 37 are permanently secured within hard layer of concrete 58. To accomplish the objects of the invention, layer 58 is deposited to an indicated depth of approximately 3.0 inches from the outside of bales 60,60'. The exterior layer 58 is brought to a straight and level condition by finishers using tools of the trade; surface treatment is then imparted to the surface of layer 58, e.g. floated, trowelled, brushed, exposed aggregate, or the like.

Figure 6:
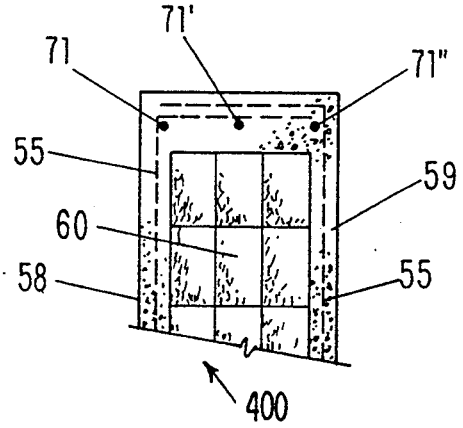
FIG. 6 is a detailed enlargement of section C—C of FIG. 3.

Wall 12 is terminated with a beam structure along its top, as shown in FIG. 6. Beam 68 preferably is constructed from concrete deposited upon the top of the final course of bales 60,60'. Concrete for beam 68 is placed at the time of deposition of first exterior layer 58, so as to cure simultaneously with it. Sides of beam 68 are formed from temporary beam forms (not shown). Beam 68 includes a plurality of steel beam reinforcing rods 71,71',71'' (e.g. #6 rebar), disposed inside beam 68 according to principles known in the art of reinforced concrete design. Welded wire mesh 55 extending from interior and exterior layers 58 and 59 is doubled over and continued into the interior of beam 68, as illustrated in FIG. 6.

As illustrated in FIG. 10, the concrete in each outside space 48 of the ribs 50,50' and in exterior hard layer 58 is allowed to cure (e.g. 24 hours) in order to attain adequate strength to provide support for the wall 12. After such an adequate curing interval has elapsed, the practice of the invention is directed to the second or interior face of wall 12. "Interior," in this context, means the side of wall 12 in contact with wall supports 34,34' and the other support system components, regardless of whether that side happens to affront the exterior or interior of a closed structure being constructed.

With combined reference to FIGS. 1, 9 and 19, after the concrete in outside spaces 48 and exterior layer 58 have cured for a sufficient time to lend strength to wall 12, the temporary support system is no longer required. The entire support system is disassembled in the reverse order of assembly, preferably by simply dissociating the various nut and bolt combinations. Typically, cross braces 42,42' are removed first, followed by wall braces 28,28' (and brace extensions 44,44', if used). Floor plates 16,16' are pulled, and front anchor bolts 20 sawed flush with slab 14 if desired. The entire assembly preferably is stowed and transported off-site for repeated use at other projects.

With the temporary support system removed from wall 12, the interior face of wall 12 is ready for treatment. The interior face of wall 12, including the interior portions of ribs 50,50', is finished in an extremely similar manner as described for the exterior face. As suggested by FIG. 10, removal of wall supports 34,34' exposes to view at the rib locations the previously installed first set of rib liners 26,26', which hold in place the previously installed thermal break 32, within which are disposed a vertically aligned plurality of connectors 36. Thermal break 32 and rib liners 26,26' define inside space 46 at each rib location. Inside space 46, like outside space 48, is filled with concrete to substantially complete the structure of each of ribs 50,50'.

As stated, the interior face of wall 12 is constructed in essentially identically the same manner as the exterior face 54. Attention is invited to FIGS. 2, 10 and 11, showing that interior vertical rebars 64,64',64'',64''' and interior horizontal bars 66 are installed within inside space 46 to erect the reinforcing cages known in the art. Just as in the case of the exterior face 54, welded wire mesh 55 and thickness control devices 56,56' are installed upon the interior faces of bales 60,60'. Installation of the shear control devices is completed by inserting rib wall ties 37' into the connectors 36 situated in thermal break 32.

Upon the installation of reinforcing steel 64,64',64'',64''', welded wire mesh 55, rib wall ties 37' and associated items, concrete is blown into inside space 46 in a manner identical to that performed upon outside space 48. Care is taken to deposit wet concrete through, in, and about the reinforcing steel 64,64',64'',64''', the rib wall ties 37', and the wire mesh 55. A second, or interior, layer of concrete 59, entirely analogous to exterior layer 58, is finished upon bales 60,60'. A plan section view of a finished wall is provided at FIG. 4.

It will be appreciated by persons skilled in the construction arts that the objects and advantages of the invention may be realized by adapting various differing embodiments of ribs 50,50' to accommodate alternative construction materials and designs. In the various possible alternative embodiments, the general courses and procedures for practicing the preferred embodiment, as described hereinabove, are followed except as they may be modified to account for the use of alternative materials and structural configurations.

Figure 12:
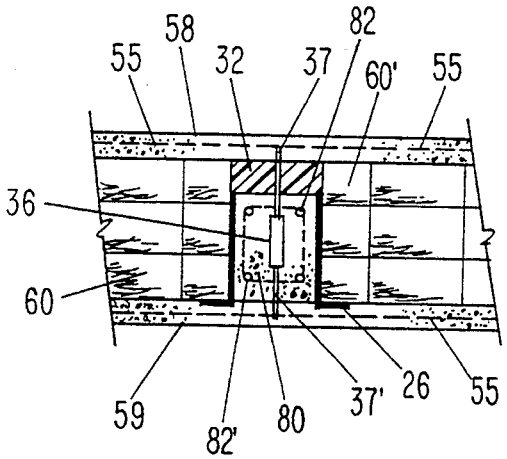
FIG. 12 is a detailed enlargement of an alternative embodiment of the embodiment of FIG. 10.

FIG. 12, for example, shows the use of a poured-in-place concrete column 80 in lieu of the "blown-in-place" concrete used in the ribs 50,50' of the preferred embodiment. In this alternative embodiment of a rib 50, concrete is poured into a reinforced column 80 between bales 60,60' using conventional forming and pouring methods. Reinforcing steel rods 82,82' are disposed within concrete column 80 according to the teachings of the existing art. The insulating advantages of the invention are maintained through the use of a thermal break 32, which is constructed and functions just as in the preferred embodiment, except that it is disposed to the exterior of column 80, so as to be in direct contact with exterior concrete layer 58.

This first alternative embodiment utilizes connectors 36 and rebar rib wall ties 37,37' adapted to perform the shear transfer functions as described in the preferred embodiment. Connectors 36 and wall ties 37,37' are temporarily held in place (e.g. by severable wires) while column 80 is poured about them. Liners 26 may be adapted for use in this alternative embodiment in order to allow the stacked bales 60,60' to serve as forms for the pouring of column 80. In this alternative embodiment, welded wire mesh 55 is used as in the preferred embodiment, while the interior 59 and exterior 58 layers of concrete are pneumatically blown and trowelled in accordance with the practice of the preferred embodiment of the invention.

Figure 13:
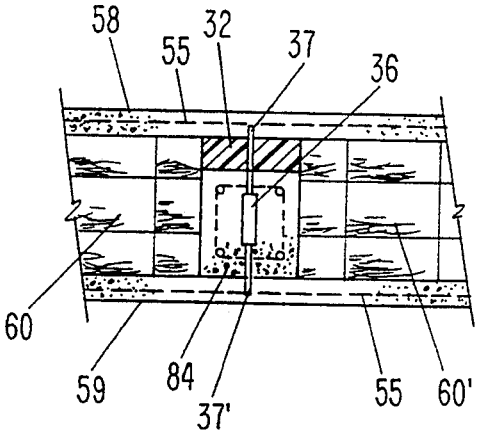
FIG. 13 is a detailed enlargement of a second alternative embodiment of the embodiment of FIG. 10.

FIG. 13 shows a second alternative embodiment of the vertical ribs 50,50' element of the invention. This second alternative embodiment is substantially identical to the first alternative embodiment, except that column 84 is made of pre-cast reinforced concrete, according to the teachings of the existing art. Because column 84 is pre-cast, no rib liners are needed or required, since bales 60,60' do not serve as supporting forms for wet concrete. Connectors 36 and wall ties 37,37' are placed at the time column 84 is pre-cast, so that they are in their proper positions at the time the column 84 is erected on site. At the time that column 84 is pre-cast, it may be desirable that ties 37,37' consist simply of straight, unbent lengths of rebar, rather than having the right-angle bend described for the preferred embodiment. According to this option, a second length of rebar is welded at a right angle to the first (i.e. parallel to the plane of the wall) prior to the installation of the interior 59 or exterior 58 layers of concrete, in accordance with the description of the corresponding elements of the preferred embodiment.

Figure 14:
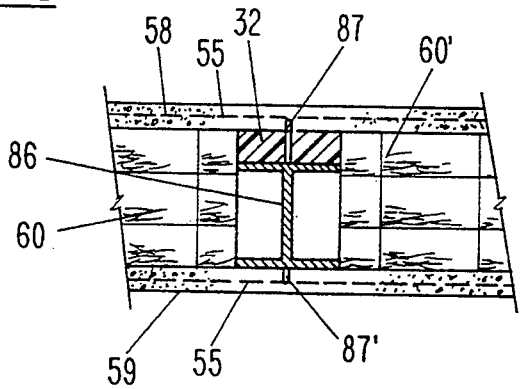
FIG. 14 is a detailed enlargement of a third alternative embodiment of the embodiment of FIG. 10.

FIG. 14 illustrates still another alternative embodiment of the rib 50 element of the invention, utilizing a steel wide-flange column 86. In this embodiment, no concrete is placed within rib 50; the steel column 86 serves the role filled by the reinforced concrete of previously described embodiments. In this embodiment, thermal break 32 is placed on the exterior side of steel column 86, and shear transfer devices 87,87' (e.g. straight or L-shaped steel rods as in previously described embodiments) are permanently attached to the exterior flange faces of steel column 86. As in other embodiments, shear transfer devices 87,87' extend into an exterior and interior concrete layers, 58 and 59. Concrete layers 58,59 preferably are pneumatically applied, and welded wire mesh 55 is incorporated within layers 58,59 as described with other embodiments. This particular embodiment may, of course, be adapted to the use of other steel columns, such as steel round or square tube pipe, in place of flanged I-beams.

It will be appreciated by one skilled in the construction arts that wood columns may be substituted for the steel and concrete columns of the described alternative embodiments. Alternative embodiments of rib 50 which incorporate wood columns present options of design flexibility and materials cost savings over concrete and steel embodiments. Wooden column alternatives include the use of thermal breaks and shear transfer devices in order to preserve the objects and advantages of the invention.

The practice of the preferred embodiment of the invention extends to the construction of roof and floor systems. The objects and advantages of a fiber-bale composite construction may be achieved by adapting the foregoing modes of erecting vertical wall systems to the construction of horizontal roof/floor systems.

Figure 15:
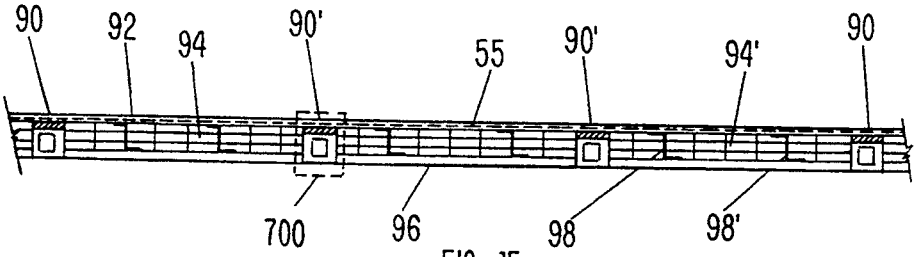
FIG. 15 is a sectional elevation view of an alternative floor/roof embodiment of the invention.
Figure 16:
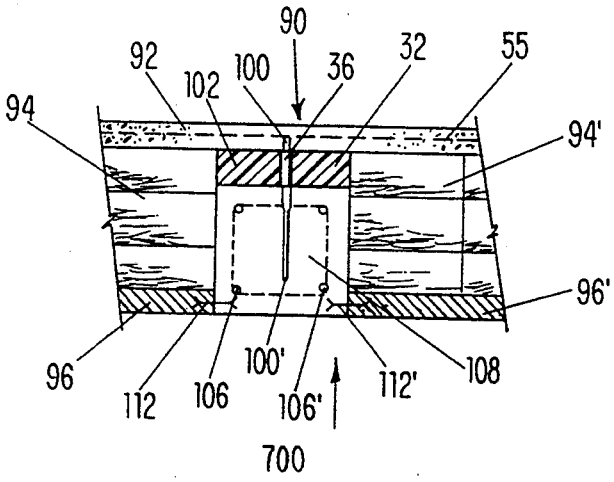
FIG. 16 is a detailed enlargement of section G—G of FIG. 15.

Attention is invited to FIGS. 15 and 16, illustrating the practice of the invention to construct a horizontal structural component. The practice of this aspect of the invention may be used to accomplish the construction of floors or roofs. Roof embodiments (including horizontal components forming the partition between floors of a two-story building) differ from floor embodiments mainly in that the roof embodiments are temporarily supported above the floor during finishing; floors may be constructed directly on grade, or may be elevated using temporary or permanent supports to form a "crawlspace" between floor and grade. It is noted that the features, methods, objects and advantages of the invention described above and applicable to the erection of wall components are generally applicable, with modest adaptation, to the erection of floors and roofs. Accordingly, the foregoing disclosure pertaining to vertical walls is here repeated by reference and is relevant to an understanding of the following disclosure pertaining to horizontal components, and will assist a person of ordinary skill in the art in the practice of the invention to construct floors and walls.

FIG. 15 is a sectional view of a typical horizontal component according to the invention. Hereafter, the horizontal component will be referred to as a roof, but it will be understood that the modes and means for practicing the invention are essentially the same for floors. As with walls, roofs are composed of a plurality of roof bales 94,94' arranged in ordered rows. In FIGS. 15 and 16, roof bales 94,94' are illustrated as being laid three layers deep. Similar to the construction of walls, however, there is no criticality to the number of layers of bales 94,94'. A single layer may be satisfactory, and the number of layers may be a function of the size of bales 94,94'. As was mentioned in the case of walls, bales 94,94' may be of any practicable and easily managed size, and larger size bales 94,94' will reduce the number of bales used and the number of layers placed.

As viewed in FIG. 15, roofs, like walls, are constructed in "bays" i.e. sections of laid bales 94,94' separated by reinforcing roof beams 90,90'. At regular intervals (e.g. 10 feet) along the length of a particular roof, allowance is made for the construction of horizontal beams 90,90', which enhance the stability and load-bearing capabilities of the roof. The sections of bales 94,94' and the beams 90,90' serve analogous functions to the bales 60,60' and ribs 50,50' of the wall embodiment.

FIG. 15 shows a three-bay portion of a roof, defined by four roof beams 90,90'.

Erection of a roof is commenced with the installation of a frame member 96. Frame member 96 is a flat, rigid, planar element preferably fashioned from lightweight metal. A plurality of frame members 96 may be used to construct a roof, depending on the number of bays; ordinarily, frame member 96 will be as wide as the bay in which it is installed, and thus span the distance between beams 90,90'. Frame members 96 preferably are horizontally installed atop a temporary scaffold-like supporting framework known in the art of building construction. The object of the temporary framework (not shown) is to horizontally suspend and support the frame members 96 the requisite distance above, and parallel to, the floor below, while the roof components is assembled and finished. Thus, the temporary framework maintains the frame members 96 at the desired height of the underside (i.e. ceiling) of the roof. It also secures the frame members 96 at their proper positions relative to previously installed walls, if any. The temporary framework consists of poles and props to be removed after installation of the complete roof assembly has been installed.

Commonly, the practice of the invention to install a roof will involve the disposition of frame members 96 at a height commensurate with the height of existing walls. For example, in a completed roof, the bottoms of outside roof beams 90 (two shown) in FIG. 15 could be placed upon (and supported by) the top of a wall (i.e. the wall beam feature shown in FIGS. 3 and 6).

With the frame members 96 in place, the bales 94,94' are laid in contiguous, horizontal rows upon frame members 96. The mode of laying is analogous to the stacking of the bales 60,60' to form a wall, and may include the steps of staking adjacent bales together and the like. As with the erection of a wall, bales 94,94' are laid in sections, the sections interrupted and spaced by vacant strips at the anticipated locations of roof beams 90,90'. As shown in FIG. 15, the laying of bales 94,94' is accompanied by the installation of roof ties 98,98'. Roof ties 98,98' are essentially identical in form and function to wall ties 35,35' described in the wall embodiment. Like wall ties 35,35', roof ties 98,98' preferably are steel rebars, and are disposed at regular intervals in two dimensions throughout the roof component, and serve to transfer shear forces between the upper and lower portions of the roof. Roof ties 98,98' preferably are accompanied by the use of connectors just like connectors 36 described and used in the wall component.

FIG. 16 is a detailed, enlarged, sectional view of the roof beam feature of the invention. A full understanding of this aspect of the invention is enhanced by comparison with FIG. 12. FIG. 12 illustrates an alternative embodiment of the wall rib 50 element of the invention, whereby the rib 50 is comprised of poured, steel-reinforced concrete accompanied by the shear transfer and thermal insulation elements of the invention. The construction of roof beam 90 is very analogous to the construction of the rib 50 of FIG. 13, except that roof beam 90 is assembled in a horizontal position.

Having particular reference to FIG. 16, it is observed that the substance of the beam 90 is disposed within a gap between stacked bales 94,94'. With frame members 96,96' in place and bales 94,94' stacked thereon, a planar form (not shown) forming a part of the temporary support system, is disposed across the gap between frame members 96,96'. Beam reinforcing rods 106,106' (e.g. #5 steel rebar, four shown) are disposed along the length of beam 90 and tied together according to the methods known to the art of reinforced concrete construction. Concrete is then pneumatically blown into the beam space 108, in and around reinforcing rods 106,106'. The wet concrete is held in place by bales 94,94' and the temporary planar form. It will is noted that plastic liners (not shown) similar to liners 26 in FIG. 12 may be employed to provide an uncontaminated form and to protect the bales 94,94 from concrete moisture. The bottom of beam 90 is tied to frame members 96,96' by juncture pins 112,112' extending from frame members 96,96' into the concrete of the beam 90. Juncture pins 112,112' are bolts or other metal pins permanently secured to and projecting from frame members 96,96' into the beam space 108, and are thus surrounded by cured concrete in the final roof product. Accordingly, frame members 96,96 are joined by juncture pins 112,112' and beams 90,90' to form the analogue of a single lower hard surface to the roof that can bear tensile loads.

Simultaneously with, or immediately after, the pneumatic placement of concrete into space 108, a plurality of roof shear pins 100,100' are disposed into the concrete at regular (e.g. 3.0 feet) intervals along the length of beam 90. Roof shear pins 100,100' may be fashioned from #4 steel rebar, and serve the same function and purpose as rib wall ties 37,37' in FIG. 12, that is, to transfer shear force from between the opposing sides of the roof. Placement of shear pins 100,100' is accompanied or followed by the installation of thermal break 32, which is essentially identical to thermal break 32 of the wall components of the invention. Likewise, roof shear pins 100,100' preferably are joined using an insulating connector 36 identical to the connectors 36 previously described.

With thermal break 32 in place, the upper surface of the roof is covered with pneumatically placed concrete to form hard layer 92, which is finished according to the existing art. Upper hard layer 92 includes welded wire mesh 55 as a reinforcing and lath agent, as with the erection of wall components. It is noted that upper roof shear pins 100 extend into concrete layer 92; upper pins 100 preferably are bent to form an extended "leg" that runs parallel with the component and within the hard layer 92, as analogously depicted in FIG. 9.

After the concrete in space 108 has been allowed to cure for the indicated amount of time necessary for the beam to be self-supporting, the temporary support network is removed from below frame members 96,96'. The entire roof assembly is then self-supporting, and the frame members 96,96' remain in place as the exposed ceiling of the enclosed structure (and may be further aesthetically finished as desired).

As will be apparent to one of ordinary skill in the art, therefore, a means is disclosed for constructing horizontal components that offer the same advantages as the means disclosed for erecting vertical walls. The finished roof is highly insulative, lightweight, and able to sustain shear forces that undo roofing assemblies in the existing art of baled construction.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents and publications cited above, and of the corresponding applications, are hereby incorporated by reference.

What is claimed is:

1. A method for erecting structures, comprising the steps of:
   (a) contiguously arranging fiber bales to form a first face and a second face;
   (b) reinforcing the arranged bales;
   (c) coating the first face with a first hard layer;
   (d) covering the second face with a second hard layer; and
   (e) providing means for transferring shear forces between the first hard layer and the second hard layer, said means for transferring shear comprising a plurality of steel ties disposed through the fiber bales and into the first hard layer and the second hard layer.

2. The method of claim 1 comprising the further step of controlling the density and moisture content of the bales prior to the step of arranging fiber bales.

3. The method of claim 2 wherein the step of controlling density and moisture content comprises hermetically packaging the bales.

4. The method of claim 1 wherein the step of arranging fiber bales comprises stacking the fiber bales in vertical courses.

5. The method of claim 4 wherein the step of coating the first face with a first hard layer comprises pneumatically blowing wet concrete onto the first face.

6. The method of claim 4 wherein the step of covering the second face with a second hard layer comprises pneumatically blowing wet concrete onto the second face.

7. The method of claim 1 wherein the step of arranging fiber bales comprises laying the fiber bales in horizontal rows.

8. The method of claim 7 wherein the step of coating the first face with a first hard layer comprises providing a rigid frame member.

9. The method of claim 7 wherein the step of covering the second face with a second hard layer comprises pneumatically blowing wet concrete onto the second face.

10. The method of claim 1 wherein the step of reinforcing the bales comprises of forming at least one concrete element within the bales.

11. The method of claim 10 wherein the step of forming a concrete element within the bales comprises the further steps of:
   (a) leaving a void in the bales to serve as a form for wet concrete;
   (b) fastening at least one liner to the bales and within the void;
   (c) placing a thermal break within the void; and
   (d) depositing wet concrete into the void.

12. The method of claim 11 wherein the step of placing a thermal break comprises placing a plastic foam barrier.

13. The method of claim 11 wherein the step of depositing concrete comprises pneumatically blowing concrete.

14. The method of claim 11 comprising the further step of mounting steel bars within the void.

15. The method of claim 1 wherein the step of reinforcing the bales comprises disposing at least one steel column within the bales.

16. The method of claim 15 wherein the step of disposing a steel column comprises the further steps of:
   (a) creating a void within the bales to allow space for said column; and
   (b) placing a thermal break within the void.

17. The method of claim 1 wherein the step of reinforcing the bales comprises disposing at least one pre-cast concrete column within the bales.

18. The method of claim 17 wherein the step of disposing a pre-cast concrete column comprises the further steps of:
   (a) creating a void within the bales to allow space for said pre-cast concrete column; and
   (b) placing a thermal break within the void.

19. The method of claim 1 comprising the further step of thermally insulating the ties with an insulative connector.

20. A composite structural system comprising:
   fiber bales contiguously arranged in rows to form a first face and a second face;
   means for reinforcing said rows of bales;
   means for coating said first face with a first hard layer;
   means for covering said second face with a second hard layer; and
   means for transferring shear forces between said first hard layer and said second hard layer, said means for transferring shear comprising a plurality of steel ties disposed through said fiber bales and into said first hard layer and said second hard layer.

21. The invention of claim 20 wherein said bales comprise bales stacked in vertical courses.

22. The invention of claim 21 wherein said means for coating said first face comprises means for pneumatically blowing concrete onto said first face.

23. The invention of claim 21 wherein said means for covering said second face comprises means for pneumatically blowing concrete onto said second face.

24. The invention of claim 20 wherein said bales comprise bales laid in rows in a horizontal plane.

25. The invention of claim 24 wherein said first hard layer comprises a rigid frame member.

26. The invention of claim 24 wherein said second hard layer comprises concrete pneumatically blown onto said second face.

27. The invention of claim 25 wherein said frame member comprises a planar metal frame.

28. The invention of claim 20 wherein said bales comprise bales whose density and moisture content have been controlled.

29. The invention of claim 20 wherein said reinforcing means comprises at least one concrete element within said bales.

30. The invention of claim 29 wherein said concrete element within the bales comprises:
   a concrete rib formed by depositing wet concrete into a form, said form comprising said bales;
   at least one liner attached to said form; and
   a thermal break within said form.

31. The invention of claim 30 wherein said thermal break comprises plastic foam.

32. The invention of claim 30 wherein said wet concrete comprises pneumatically blown concrete.

33. The invention of claim 30 further comprising steel bars disposed within said concrete.

34. The invention of claim 20 wherein said reinforcing means comprises:
   at least one steel column within the bales; and
   a thermal break placed against said steel column.

35. The invention of claim 20 wherein said reinforcing means comprises:

at least one pre-cast concrete column within the bales;

a thermal break within the column.

36. The invention of claim 20 wherein said securing means further comprises means for thermally insulating said ties.

37. A method for erecting structures, comprising the steps of:

(a) providing a temporary support system;

(b) vertically stacking fiber bales into at least two sections against the temporary support system;

(c) leaving vertical space between the sections of stacked bales;

(d) filling a first vertical portion of the vertical space with reinforcement;

(e) covering a first face of the stacked bales with a first structural hard layer in connective contact with the reinforcement;

(f) removing the temporary support system;

(g) filling a second vertical portion of the vertical space with reinforcement; and (h) coating a second face of the stacked bales with a second structural hard layer in connective contact with the reinforcement.

38. The method of claim 37 wherein the step of providing a temporary support system comprises providing a portable reusable support system.

39. The method of claim 37 wherein the step of stacking fiber bales further comprises the step of disposing a plurality of shear force transfer devices within the bales such that shear force transfer devices contact the first hard layer and the second hard layer.

40. The method of claim 39 wherein the step of disposing shear transfer devices comprises disposing steel rebar wall ties.

41. The method of claim 40 wherein the step of disposing rigid wall ties further comprises the step of thermally insulating the wall ties with insulative connectors.

42. The method of claim 37 wherein the step of filling a first portion of the vertical space with reinforcement comprises the further steps of:

(a) attaching at least one liner to the bales and within the first portion of the vertical space;

(b) mounting a thermal break against the liner and within the vertical space;

(c) placing reinforcing rods within the first portion of vertical space;

(d) securing at least one shear transfer device within the vertical space such that the shear transfer device contacts the first hard layer and; and (e) depositing wet concrete in the first portion of the vertical space.

43. The method of claim 37 wherein the step of filling a second portion of the vertical space with reinforcement comprises the further steps of:

(a) attaching at least one liner to the bales and within the second portion of the vertical space;

(b) placing reinforcing rods within the second portion of vertical space;

(c) securing at least one shear transfer device within the vertical space such that the shear transfer device contacts the second hard layer and; and (d) depositing wet concrete in the second portion of the vertical space.

44. The method of claim 37 comprising the further steps of (a) installing temporary support to a frame member;

(b) laying fiber bales in horizontal rows upon the frame member;

(c) reinforcing the horizontally laid bales;

(d) coating an upper face of the bales with a first hard layer;

(d) providing means for transferring shear forces from the upper hard layer to the frame member; and (e) removing the temporary support.

45. The method of claim 44 wherein the step of reinforcing the bales comprises forming at least one concrete element within the bales.

46. The method of claim 45 wherein the step of forming a concrete element within the bales comprises the further steps of:

(a) leaving a void in the bales to serve as a form for wet concrete;

(b) fastening at least one liner to the bales and within the void;

(c) placing a thermal break within the void; and (d) depositing wet concrete into the void.

* * * * *